US011365947B2

(12) United States Patent
Lawrie

(10) Patent No.: US 11,365,947 B2
(45) Date of Patent: Jun. 21, 2022

(54) LOCKING ASSEMBLY FOR FIREARM TRIGGER SAFETY MECHANISMS

(71) Applicant: David Lawrie, Crozet, VA (US)

(72) Inventor: David Lawrie, Crozet, VA (US)

(73) Assignee: MACHINE INC, Crozet, VA (US)

( * ) Notice: Subject to any disclaimer, the term of this patent is extended or adjusted under 35 U.S.C. 154(b) by 0 days.

(21) Appl. No.: 16/983,467

(22) Filed: Aug. 3, 2020

(65) Prior Publication Data

US 2022/0034614 A1 Feb. 3, 2022

(51) Int. Cl.
*F41A 17/06* (2006.01)
*F41A 17/48* (2006.01)

(52) U.S. Cl.
CPC ..... *F41A 17/48* (2013.01); *F41A 17/063* (2013.01)

(58) Field of Classification Search
CPC ..... F41A 17/06; F41A 17/063; F41A 17/46; F41A 17/48
See application file for complete search history.

(56) References Cited

U.S. PATENT DOCUMENTS 5,448,847 A * 9/1995 Teetzel ..... F41A 17/066 42/70.05
5,896,691 A * 4/1999 Kaminski ..... F41A 17/08 42/70.11
8,893,420 B2 * 11/2014 Milde, Jr. ..... F41A 17/066 42/70.06
9,222,740 B1 * 12/2015 Milde, Jr. ..... F41A 17/066
9,377,259 B2 * 6/2016 Milde, Jr. ..... F41A 17/066
9,395,133 B2 * 7/2016 Milde, Jr. ..... G07C 9/00174
9,726,448 B1 * 8/2017 Milde, Jr. ..... F41A 17/066
9,739,555 B2 * 8/2017 Milde, Jr. ..... F41A 17/44
9,879,932 B2 * 1/2018 Milde, Jr. ..... F41A 17/46
10,113,823 B2 * 10/2018 Alicea, Jr. ..... F41A 17/20
10,746,490 B1 * 8/2020 Yu ..... F41A 17/063
2014/0215881 A1 * 8/2014 Milde, Jr. ..... G07C 9/00896 42/70.06
2015/0068093 A1 * 3/2015 Milde, Jr. ..... F41A 17/063 42/70.11
2015/0184965 A1 * 7/2015 Milde, Jr. ..... F41A 35/00 42/70.06
2016/0273859 A1 * 9/2016 Milde, Jr. ..... F41A 17/22
2016/0327356 A1 * 11/2016 Milde, Jr. ..... F41A 17/44
2017/0227315 A1 * 8/2017 Milde, Jr. ..... F41A 35/00
2018/0224231 A1 * 8/2018 Weinberg ..... F41A 17/42
2019/0219351 A1 * 7/2019 Weinberg ..... F41G 11/003
2019/0226785 A1 * 7/2019 Delgado Acarreta ... F41A 17/06
2020/0386503 A1 * 12/2020 Moretti ..... F41A 17/52

* cited by examiner

*Primary Examiner* — Jonathan C Weber

(57) ABSTRACT

A system for improving firearm safety is provided. The system comprises a firearm with a trigger mechanism for firing and a trigger safety member proximate the trigger to prevent accidental firing. The system also comprises a locking assembly associated with the trigger mechanism and safety member comprising a transceiver that receives a message from a remote wireless device. The locking assembly further comprises a motor that activates based on processing of the message received by the transceiver. The locking assembly further comprises an eccentric that executes a first turning motion based on action of the motor.

20 Claims, 6 Drawing Sheets

LOCKING ASSEMBLY FOR FIREARM TRIGGER SAFETY MECHANISMS

FIELD OF THE INVENTION

The present disclosure is in the field of firearm safety. More particularly, the present disclosure teaches systems and methods of blocking a trigger safety mechanism of a firearm such that the mechanism cannot be moved and the firearm thus unable to be discharged.

BACKGROUND

Gun safety rules and practice recommendations are intended to avoid accidental and unauthorized discharge or negligent discharge, or the consequences of firearm malfunctions. Their purpose is to eliminate or minimize the risks of unintentional death, injury or property damage caused by improper possession, storage or handling of firearms.

A locking safety mechanism or safety is a component of the trigger assembly in many popular handguns. The safety mechanism stops the gun from being fired without the user first manipulating a component which disengages the safety mechanism so the gun can fire. In many popular models, the safety is alongside the trigger such that once the safety is pulled, the trigger alongside the safety can then be pulled and the firearm discharged.

In many handguns, the safety is immediately adjacent the trigger. A user wishing to fire the weapon pulls the safety, deactivating it, and pulls the adjacent trigger, discharging the weapon.

DETAILED DESCRIPTION

Figure 1:
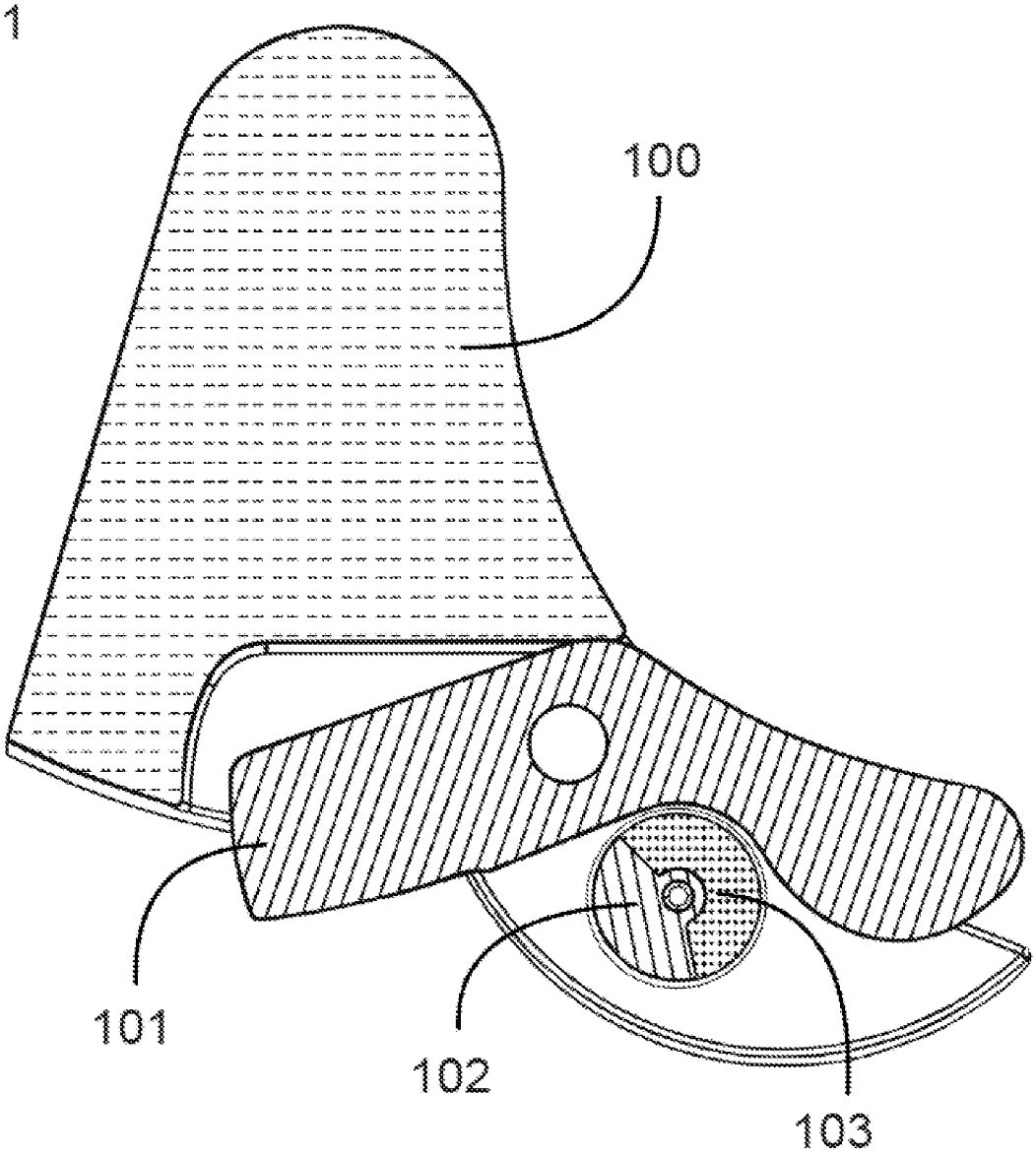
FIG. 1 is a diagram of a locking assembly for firearm trigger safety mechanisms according to an embodiment of the present disclosure.

The present disclosure is directed to firearm safety and to supplement existing methods for securing a trigger safety mechanism or safety of a firearm. A locking assembly provided herein interferes with the safety engage/disengage process by moving and inserting a mechanical stop or eccentric into the path of the safety. The safety consequently cannot be pulled and therefore released and the trigger hence not accessible. The risk of accidental or unauthorized discharge of the firearm is thus reduced.

The process of unlocking and locking the safety as provided herein may be controlled electronically via an application or app on a mobile device such as a mobile phone. A user of the device can configure the app such that once the firearm and the mobile device are more than a predetermined distance from one another, the eccentric is moved into position causing the safety to be blocked and the firearm no longer able to fire.

The locking assembly provided herein comprises the eccentric and a small motor embedded in or near the trigger. The motor moves the eccentric forward and backward. Each such movement of lock or unlock, respectively, causes the eccentric to be secured in place by a spring which rests in a small cut out groove of the eccentric. A power source for moving the eccentric and electronic parts are also local.

The eccentric and motor, when in forward and locked position with the eccentric secured in place, prevents the safety from being moved and therefore released. The trigger cannot be pulled and the gun therefore cannot be fired.

The locking assembly comprising eccentric and motor may attach to or be embedded into the trigger. The eccentric is semi-circular in shape and turns on an axis perpendicular to the direction of the trigger's movement. The motor turns the eccentric into position to block the safety from being released.

Once the eccentric is in forward position and held there, the safety is blocked and cannot be moved. Conversely, when the firearm is to be discharged or be otherwise readied for firing, the motor turns the eccentric backward such that it no longer blocks the safety. The safety can be pulled, releasing it, and thereafter the trigger can be accessed and the firearm discharged.

The motor contained in the locking assembly is remotely controlled by the mobile device and a programmable application executing thereon. The motor may receive instructions via a locally operating transceiver. The application is password protected and allows the user to configure a distance from the firearm wherein the locking assembly is enabled or disabled, hence blocking or unblocking, respectively, movement of the safety mechanism.

When the mobile device detects that the firearm is within the configured distance, the motor moves the eccentric out of blocking position. The safety may then be released and the weapon may be fired.

Should the weapon and mobile device be moved beyond the predetermined distance from each other, the motor may automatically move the eccentric into position, blocking movement of the safety, and preventing accidental or unauthorized discharge of the weapon.

Systems and methods also provide for the locking mechanism to be engaged and the firearm disabled even if the firearm and the mobile device are together or otherwise within the predetermined distance. In an embodiment involving an emergency and prevention of a possible tragedy, a user may have placed the firearm and the mobile device together in an item of luggage, for example. The user in this example may misplace the luggage or discover that the luggage has been stolen.

The present disclosure provides for the user to remotely and with minimal delay access an Internet web site from a browser or a toll-free number from a telephone and order immediate disabling of the firearm via activation of the locking mechanism. This action thus overrides the functionality described above regarding disabling and enabling the firearm based on the predetermined distance and therefore allows the possibility of a tragedy to be circumvented.

Turning to the figures, FIG. 1 is a diagram of a system of the locking assembly as provided herein. A trigger mechanism 100 or trigger 100 is shown which effectively hosts a safety mechanism 101 or safety 101. The safety 101 rotates or is moved on an axis that is attached to the trigger mechanism 100. The components of the locking assembly are also physically hosted by the trigger mechanism 100.

An eccentric 102 is a semicircular component that turns on an axis. In FIG. 1, the eccentric 102 is shown in disengaged position such that the safety 101 can be moved and the firearm able to be discharged. In FIG. 1, the safety 101 is shown in engaged position because it must be pulled for the trigger 101 to be pulled. But because the eccentric 102 is not engaged, i.e. it is in a position away from the safety 101, the safety 101 can be pulled and the trigger 100 thereafter can be engaged, discharging the firearm.

FIG. 1 also depicts the motor 103. The eccentric 102 remains in place after the eccentric 102 has been moved by the motor 103 in accordance with instructions from the mobile device.

Figure 2:
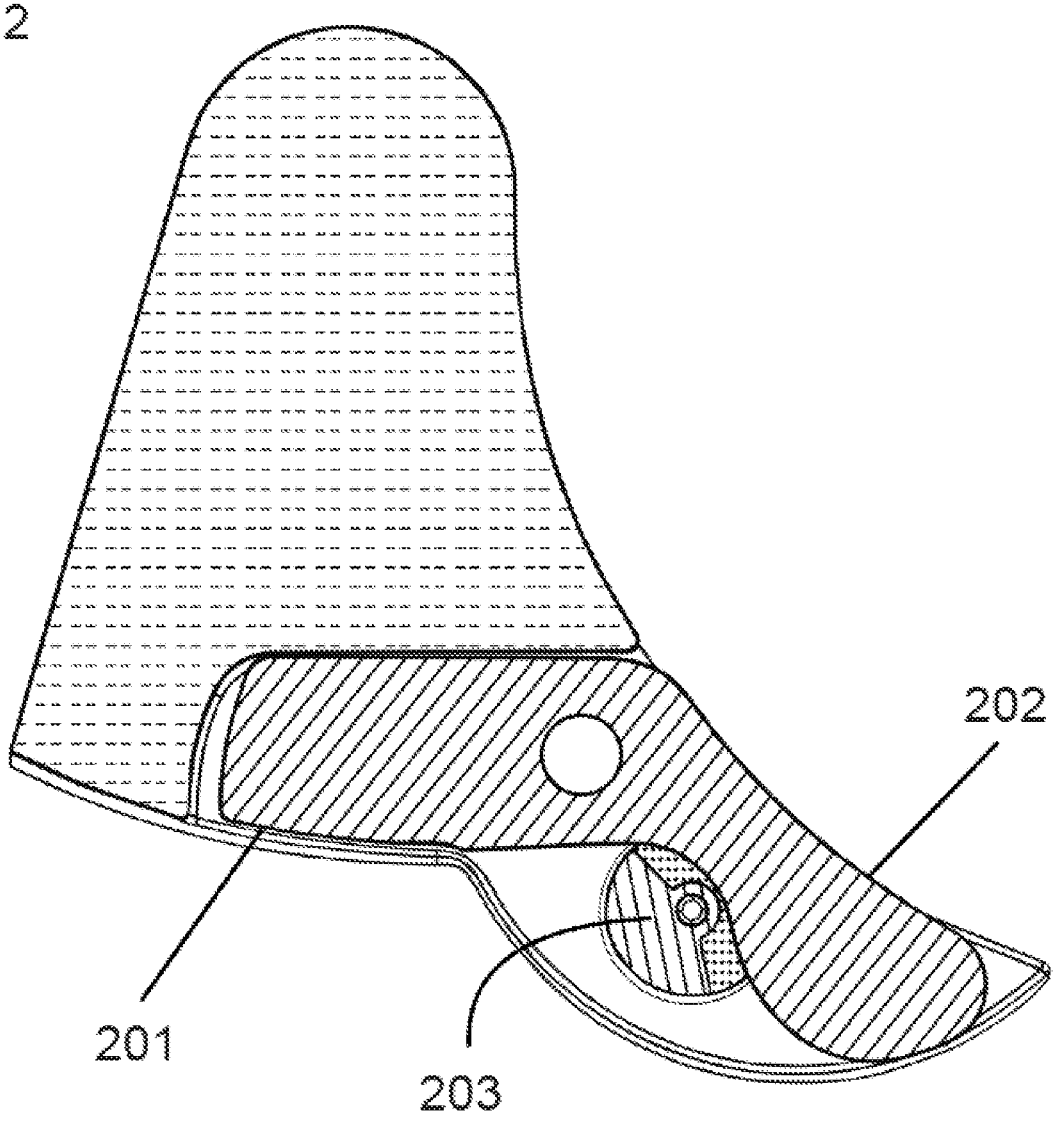
FIG. 2 is a diagram of a locking assembly for firearm trigger safety mechanisms according to an embodiment of the present disclosure.

FIG. 2 is a diagram of a system of the locking assembly as provided herein. Component 202 is not a physical component but rather represents the process of the safety being pushed downward which will move the other end of the safety into the trigger cavity where component 201 is directed. Because the mechanism (the eccentric 203) is in non-engaged position, the safety can be depressed which allows the trigger to be accessed and the firearm to be discharged.

Figure 3:
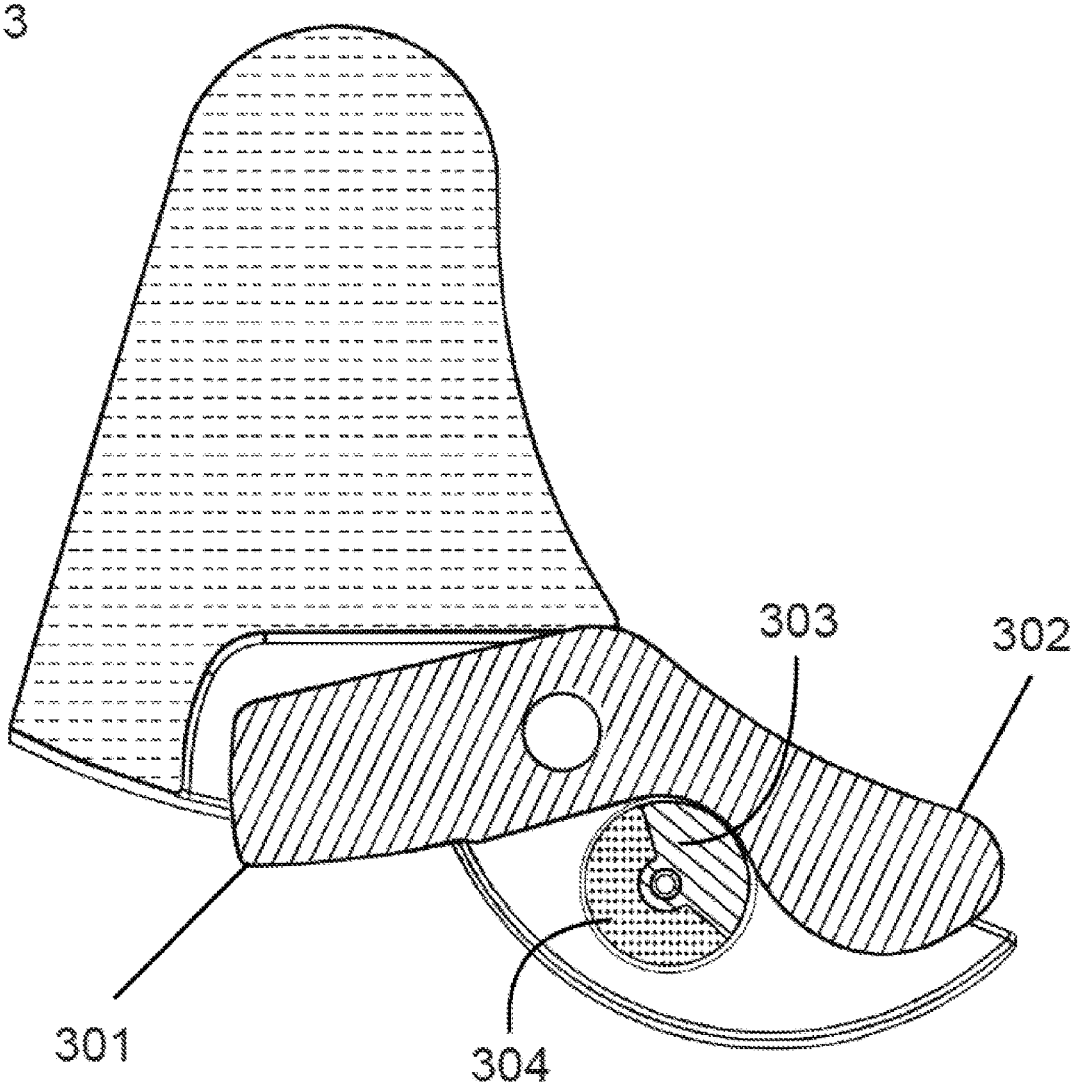
FIG. 3 is a diagram of a locking assembly for firearm trigger safety mechanisms according to an embodiment of the present disclosure.

FIG. 3 is a diagram of the locking assembly with the eccentric 303 having been rotated into locked position by the motor 304 and held there. The safety is shown in engaged and locked position. Component 302 is not a physical component but as above is rather the action of the safety being pushed downward which cannot take place, in contrast to FIG. 2 described above, because of the positioning of the eccentric 303 as described herein. The other end of the safety is shown as component 301 depicting the safety in exposed and engaged position such that the firearm cannot be discharged.

Figure 4:
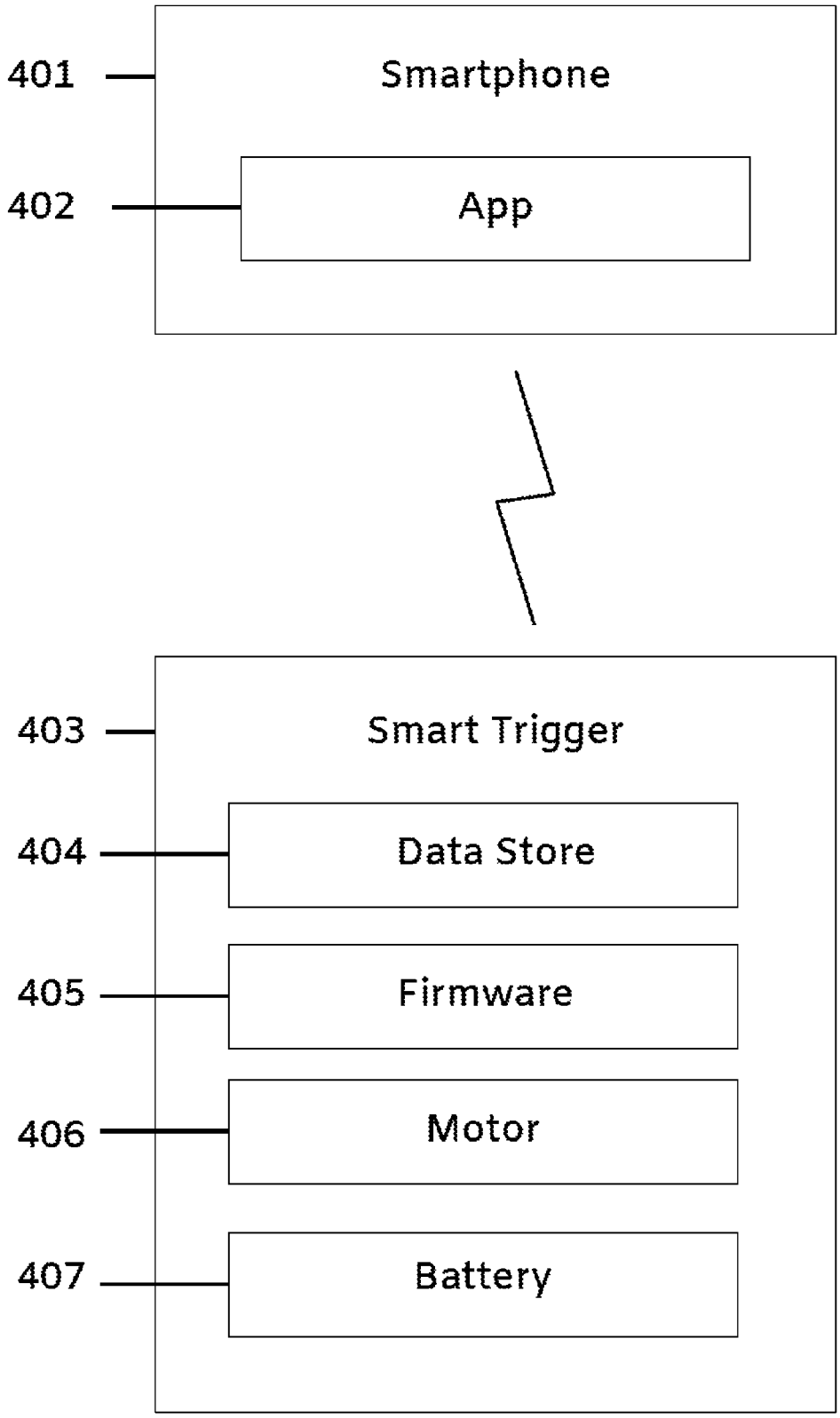
FIG. 4 is a flowchart logical diagram of a locking assembly for firearm trigger safety mechanisms according to an embodiment of the present disclosure.

FIG. 4 is a diagram of the system of a locking mechanism. FIG. 4 depicts a mobile device, a smartphone 401 on which an app 402 is executing. The app 402 is used to configure the distance described above within which the locking mechanism might automatically unlock and make firearm able to be discharged.

FIG. 4 also depicts a smart trigger 403 which refers to the locking mechanism described above. The smart trigger 403 includes a data store 404 which stores configuration information entered by a user. The smart trigger 403 includes firmware 405, which may at least in part be non-volatile software instructions as to when and how the eccentric described above is to be moved. The smart trigger 403 further includes a motor 406, described above, and a battery 407 that provides power to the motor 406.

Figure 5:
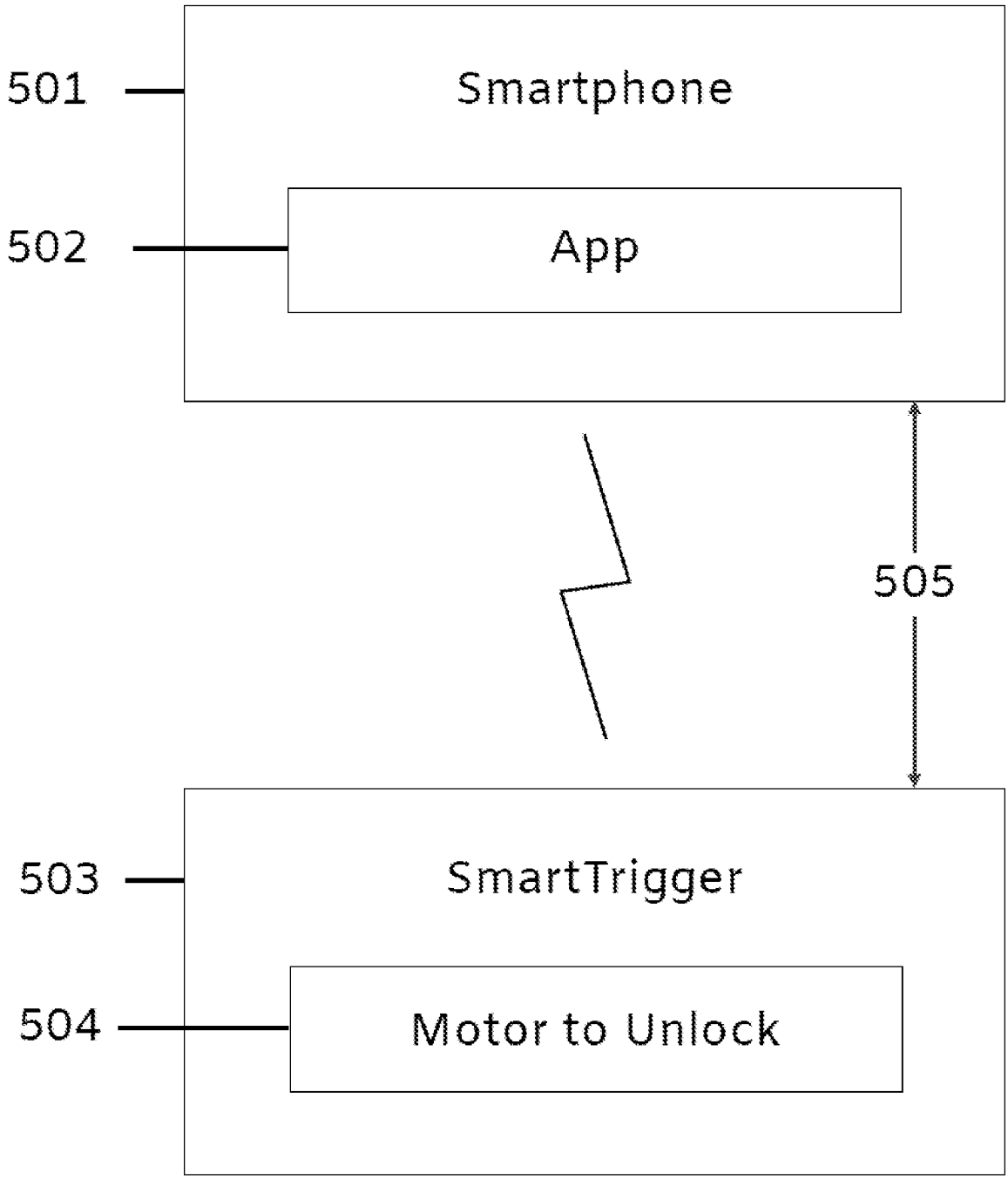
FIG. 5 is a flowchart logical diagram of a locking assembly for firearm trigger safety mechanisms according to an embodiment of the present disclosure.

FIG. 5 is another diagram of the system of locking mechanism described herein. FIG. 5 depicts a smartphone 501 and an app 502 described above that communicate wirelessly with a smart trigger 503 and a motor to unlock 504 also described above. A distance 505 is also depicted which represents a physical amount of space between the smartphone 501 and the smart trigger 503. The distance 505 is relatively small, suggesting that the motor to unlock 504 may unlock the eccentric as described above.

Figure 6:
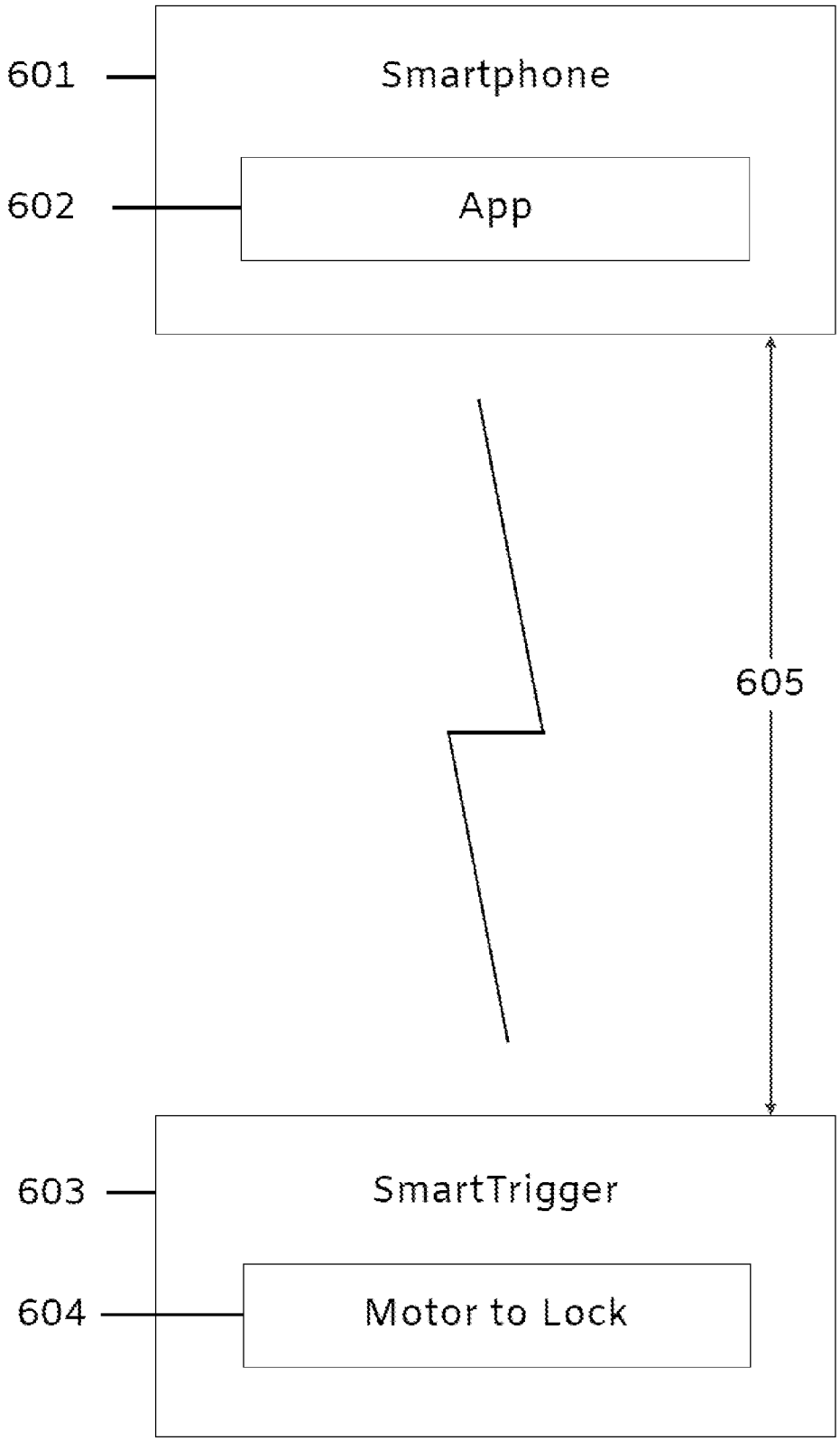
FIG. 6 is a flowchart logical diagram of a locking assembly for firearm trigger safety mechanisms according to an embodiment of the present disclosure.

FIG. 6 is another diagram of the system of locking mechanism described herein. FIG. 6 depicts a smartphone 601 and an app 602 described above that communicate wirelessly with a smart trigger 603 and a motor to unlock 604 also described above. A distance 605 is also depicted which represents a physical amount of space between the smartphone 601 and the smart trigger 603. The distance 605 is relatively greater than the distance 505 shown in FIG. 5, suggesting that the motor to unlock 504 may lock the eccentric as described above.

What is claimed is:

1. A system for improving firearm safety, comprising:
- a firearm with a trigger for firing;
- a trigger safety member proximate the trigger to prevent accidental firing; and
- a locking assembly associated with the trigger and safety member comprising:
  - a transceiver that receives a message from a remote wireless device,
  - a motor that activates based on processing of the message received by the transceiver, and
  - an eccentric that executes a first turning motion based on action of the motor, wherein the locking assembly is at least partially embedded in the trigger.

2. The system of claim 1, wherein upon receipt of turning action, the eccentric blocks movement of the trigger safety member.

3. The system of claim 1, wherein alternative to the transceiver receiving the message to cause prevention of movement of trigger safety member, the locking assembly detects movement of the remote wireless device beyond a predetermined distance from the firearm, the detection resulting in prevention of movement of the trigger safety member by the eccentric.

4. The system of claim 1, wherein based on receipt of a second message by the locking assembly, the motor activates and causes the eccentric to execute a second turning motion resulting in release of the eccentric.

5. The system of claim 4, wherein based on execution of the second turning motion, the eccentric discontinues blocking movement of the safety device.

6. The system of claim 1, wherein the eccentric is shaped in a semicircular fashion and turns on an axis, thus enabling blocking and unblocking of movement of the safety device.

7. The system of claim 1, wherein in an emergency situation, configurations regarding distance between the remote wireless device and the firearm are overridden to remotely block movement of the safety device via access by an authorized party of at least one of an Internet web browser and a toll-free telephone number.

8. The system of claim 1, wherein the locking assembly further comprises software that is remotely programmable.

9. A method for remotely blocking and unblocking a firearm safety device, comprising:
- a mobile device receiving a first entry associated with blocking movement of a trigger safety member of a remotely located firearm;
- the mobile device transmitting a first message to a locking assembly attached to the firearm and at least partially embedded in a trigger of the firearm, the first message instructing the locking assembly to block the movement of the trigger safety member; and
- the mobile device receiving a second message from the locking assembly, the second message confirming that the trigger safety member is blocked.

10. The method of claim 9, wherein the mobile device confirms that a user providing the first entry is authorized to cause operations of the locking assembly.

11. The method of claim 9, further comprising:
- the mobile device receiving a second entry associated with unblocking movement of the trigger safety member;
- the mobile device transmitting a third message to the locking assembly, the third message instructing the locking assembly to unblock the movement of the trigger safety member; and the mobile device receiving a fourth message from the locking assembly, the second message confirming that the trigger safety member is unblocked.

12. The method of claim 9, wherein an application executing on the mobile device processes entries associated with operations of the trigger safety member.

13. The method of claim 9, further comprising the mobile device transmitting instructions for automatic blocking and unblocking movement of the trigger safety member based on detection by the locking assembly of movement of the mobile device beyond and within, respectively, a specific range of the firearm.

14. The method of claim 13, further comprising the mobile device receiving a first override instruction based on entry of a credential, the mobile device, based on the instruction, disabling automatic blocking and unblocking movement of the trigger safety member based on detection by the locking assembly of movement of the mobile device beyond and within, respectively, a specific range of the firearm.

15. A system for automatically locking and unlocking a firearm trigger safety member based on proximity of authorized user, comprising:

a firearm with a trigger for firing;

a trigger safety member proximate the trigger to prevent accidental firing; and a locking assembly associated with the trigger and the trigger safety member that:

detects presence of a mobile device within a predetermined distance of the firearm, and causes, based on the detection, an eccentric to unblock the trigger safety member, wherein the locking assembly is at least partially embedded in the trigger.

16. The system of claim 15, wherein the locking assembly detects that the mobile device is not within the predetermined distance of the firearm and causes, based on the detection, the eccentric to block the trigger safety member.

17. The system of claim 15, wherein the trigger safety member is blocked by movement of an eccentric into a first position.

18. The system of claim 17, wherein the eccentric is moved by action of a motor resident in the locking assembly.

19. The system of claim 15, wherein the distance is programmable by an application executing on the mobile device.

20. The system of claim 15, wherein the eccentric is shaped in a semicircular fashion and turns on an axis, thus enabling blocking and unblocking of movement of the safety device.

* * * * *